United States Patent [19]

Ando et al.

[11] Patent Number: 4,892,050

[45] Date of Patent: Jan. 9, 1990

[54] SEWING MACHINE HAVING APPARATUS FOR INDICATING ELONGATED PATTERN MAGNIFICATION

[75] Inventors: Takumi Ando; Toshitaka Toyomi; Yasuhiro Osanai, all of Tokyo, Japan

[73] Assignee: Janome Sewing Machine Company Limited, Japan

[21] Appl. No.: 192,418

[22] Filed: Apr. 29, 1988

[30] Foreign Application Priority Data

Apr. 30, 1987 [JP] Japan ..... 62-107045

[51] Int. Cl.[4] ..... D05B 3/02

[52] U.S. Cl. ..... 112/458; 112/445; 112/456

[58] Field of Search ..... 112/456, 458, 453, 457, 112/445, 462, 121.11, 121.12

[56] References Cited

U.S. PATENT DOCUMENTS 4,270,472 6/1981 Suzuki et al. ..... 112/462 X
4,280,423 7/1981 Goncharko ..... 112/456 X
4,599,959 7/1986 Sano et al. ..... 112/456 X
4,651,663 3/1987 Murakami et al. ..... 112/458

*Primary Examiner*—Peter Nerbun
*Attorney, Agent, or Firm*—William A. Drucker

[57] ABSTRACT

An apparatus of a sewing machine for indicating elongated pattern length is disclosed, wherein memory means normally stores a number of pattern data for forming the stitches of different patterns with a standard stitch amplitude and a standard fabric feed pitch, pattern selection means is selectively operated to select a desired pattern from the pattern data storing memory, amplitude setting means is optionally operated to set the amplitude value of the selected pattern, indication means indicates an amplitude value of the selected pattern set by the amplitude setting means, pattern elongation setting means is optionally operated to set a pattern elongating magnification value, discrimination means judges whether the selected pattern is elongatable or not, and means is provided for displaying the pattern elongating magnification value in the indicating means.

1 Claim, 3 Drawing Sheets

SEWING MACHINE HAVING APPARATUS FOR INDICATING ELONGATED PATTERN MAGNIFICATION

BACKGROUND OF THE INVENTION

1. Field of the Invention

This invention relates to a sewing machine, and, more particularly, to an improved apparatus for indicating a magnification of an elongated pattern to be sewn by the sewing machine.

2. Description of the Prior Art

A conventional sewing machine may be able to sew elongated patterns and is provided with means for setting pattern length, that is, a magnification of a pattern to be elongated, as well as means for setting fabric feeding pitches and amplitudes of the swingable needle, but the sewing machine has failed to indicate the length of the elongated pattern except indicating one of the feeding pitches and needle amplitudes.

It has been desired in sewing operation to select elongated patterns of optional magnification while simultaneously confirming the display or indication of the pattern elongating magnification on the sewing machine. In fact, it will be more convenient, if a selected feeding pitch is displayed in addition to the display of a selected pattern elongating magnification. It is often required to adjust the feeding pitch of the elongated pattern while sewing. In this case, indication of feeding pitch is useful to meet this requirement.

In any event, a novel indication means has been expected to indicate both feeding pitch and elongated pattern magnification.

When general or ordinal pattern sewing, instead of elongator pattern sewing, is carried out, both a feeding pitch and a needle amplitude are set and as a result it is desired that the set values are displayed respectively. When an elongated pattern is sewed, it is desired that the set values of the feeding pitch and pattern magnification are displayed respectively for confirmation of the set condition.

SUMMARY OF THE INVENTION

According to the present invention, when a standard pattern is selected while a feeding pitch is optionally set, a first indicating part is effective to indicate a digital value of the set feeding pitch and a second indicating part is effective to indicate a digital value of the needle amplitude. On the other hand, if an elongated pattern is selected while a feeding pitch is set, the first indicating part is effective to indicate a digital value of the set feeding pitch and the second indicating is effective to indicate an elongating magnification.

Consequently, it is an object of the present invention to provide an improved sewing machine having means elongated for judging whether the selected pattern to be sewn is an elongatable pattern or not. When an elongatable pattern is selected, the needle amplitude value indicating means, namely the second indicating part is changed over to display a digital value of the selected pattern elongating magnification instead of the needle amplitude value.

BRIEF DESCRIPTION OF THE DRAWINGS

The foregoing and further objects and advantages of the invention will be fully understood from the following detailed description when read in conjunction with the accompanying drawings, in which.

DETAILED DESCRIPTION OF THE INVENTION

Figure 2:
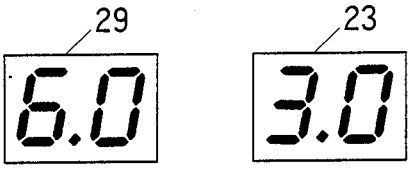
FIG. 2 is one phase of the invention.
Figure 3:
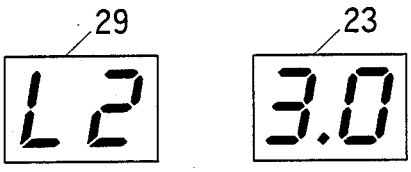
FIG. 3 is another phase of the invention.
Figure 4:
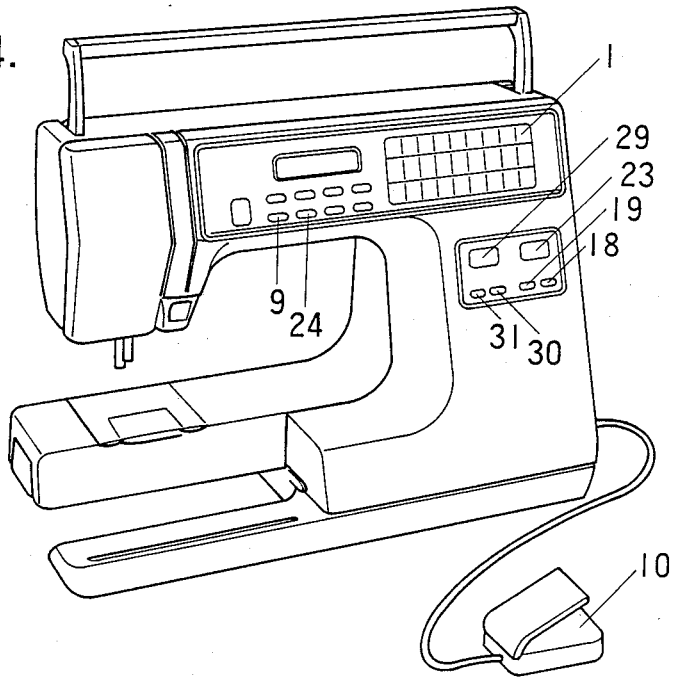
FIG. 4 is a perspective view of the sewing machine improved according to the present invention.

Now in reference to FIGS. 2, 3 and 4, the sewing machine of the invention has a memory key 9 provided to memorize the pattern selected by the pattern selecting keys 1.

The basic principle of pattern selection and pattern indication is described in the same applicant's U.S. Pat. No. 4,181,086.

The reference numeral 23 is a feed indication device for displaying a selected feeding pitch in a two-figure digital value by means of seven-segment LED.

A manual feeding UP key 18 and a manual feeding DOWN key 19 are selectively operated to increase or decrease a feeding pitches of a pattern selected from a pattern storing memory 4.

An indication device 29 is for displaying the amplitude of the selected pattern in two-figure digital value by seven segment LED as shown in FIG. 2. However in FIG. 3, the indication device 29 is switched to display a magnification of a pattern to be elongated. As to character L-2 displayed in the indication device 29 by way of example, L-represents that the pattern is elongated, and 2-represents that the elongating magnification is twice. The indication device 29 can be also switched to display a two-figure digital value representing the amplitude of the elongated pattern.

An amplitude manual UP key 30 and an amplitude manual DOWN key 31 are selectively operated to increase or decrease the amplitude value of a pattern selected from the pattern storing memory 4.

When a pattern elongation key 24 is operated, a length value, that is, the elongation magnification (L) of the elongated pattern is increased or decreased in the order of integers.

A controller 10 is operated to start and stop the sewing machine and to adjust its operating speed.

Figure 5:
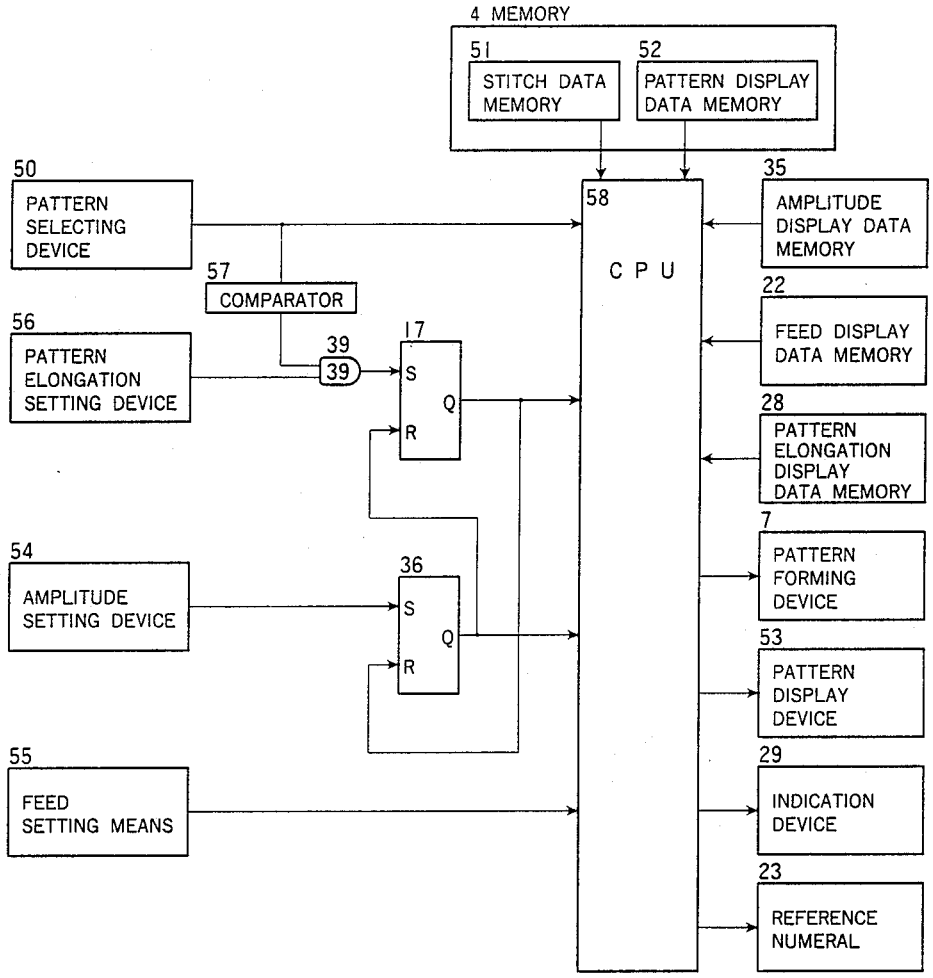
FIG. 5 is a block diagram of a system employed in the present invention.

The embodiment of the present invention will be explained with reference to FIG. 5 showing a control system.

A pattern selecting device 50 includes a plurality of pattern selecting keys 1 selects which are selectively operated to select the patterns memorized in the pattern storing memory 4. The memory device 4 is composed of a stitch data memory 51 and a pattern display data memory 52. The memory 51 has stitch data of different patterns stored therein for controlling a pattern forming device 7, and the memory 52 has pattern display data stored therein for displaying the selected pattern in a pattern indication device 54.

An amplitude setting device 54 includes the amplitude manual UP key 30 and the amplitude manual DOWN key 31 which are selectively operated to set the amplitude value of the selected pattern.

A feed setting means 55 includes the feed manual UP key 18 and the feed manual DOWN key 19 which are selectively operated to set the fabric feed amount of the selected pattern.

An elongation setting device 56 includes the pattern elongation key 24 which is operated to change the elongation magnification of the selected pattern while the density of the stitches are maintained constant.

A discriminator 57 discriminates or judges whether the pattern selected by the pattern selecting device 50 is elongatable or not.

An amplitude display data memory 35 has the amplitude display data stored therein corresponding to the values to be set by the amplitude setting device 54.

A feed display data memory 22 has the feed display data stored therein corresponding to the values to be set by the feed setting means 55.

A pattern elongation display data memory 28 has the pattern magnification indication data stored therein corresponding to the values to be set by the pattern elongation setting device 56.

A pattern forming device 7 in responsive to the stitch data read out from the stitch data storing memory 51 to control the needle swinging amplitude and the fabric feeding amount.

A pattern display device 53 is constructed of any means such as LED for displaying a pattern shape according to the display data of the pattern memorized in the pattern display data memory 52.

The indication device 29 displays selectively the amplitude value and pattern elongating magnification memorized in the amplitude display data memory 35. The indication device 23 displays a feed pitch value memorized in the feed display data memory 22. These elements as mentioned above are electrically connected to a central processing unit 58.

When the pattern selecting device 50 is selectively operated, the pattern display data of selected pattern is read out from the pattern display data memory 52 of the pattern storing memory 4 is and is displayed in the pattern display device 53 and simultaneously the corresponding stitch data is read out from the stitch data memory 51 to control the pattern forming device 7 for forming the stitch of selected pattern.

In order to adjust the amplitude and feeding pitch of the selected pattern, the amplitude setting device 54 and the feed setting device 55 are operated to read out the display data from the amplitude display data memory 35 and the feed display data memory 22 respectively to display the pattern amplitude value and the feed pitch value in the amplitude indication device 29 and the feed indication device 23 respectively.

When the pattern elongation setting device 56 is operated while the pattern selected by the pattern selection means 50 is judged as to being elongatable, a signal is produced through AND-gate 39 to a set sides of a flip-flop 17, then a signal is outputted from the output side-Q which is transmitted a reset terminal-R of another flop-flop 36 to reset it to change an amplitude display data stored in an amplitude as shown in display data storing memory 35 to a pattern elongation display data stored in a pattern elongation display data storing memory 28 to be displayed in the indication device 29 as shown in FIG. 3.

The display data consists of a combination of a letter data of L representing the pattern elongation and a numeral data representing the magnification of the elongated pattern.

When the amplitude setting means 54 is operated again to set an amplitude of the selected pattern, the set signal is produced to the set side S of the flip-flop 36, which is then operated to produce an output from the output side Q, the reset side R of the flip-flop 17 to reset the same, and the amplitude display data memorized in the amplitude display data memory device 35 is read out to be displayed in the indication device 29 in place of the pattern elongation display.

Figure 1:
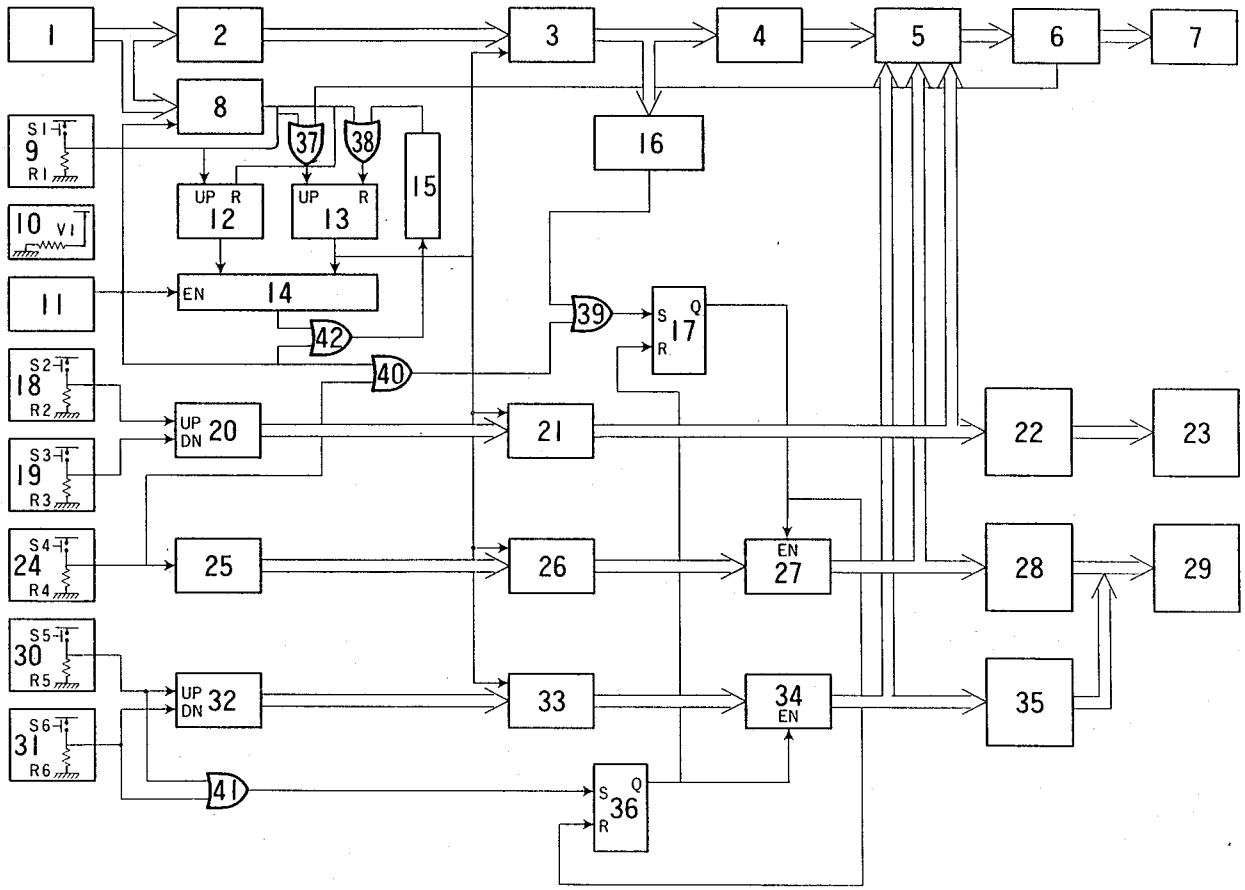
FIG. 1 is a block diagram showing an electrical structure of an embodiment of the present invention.

The operation of the embodiment of the present invention will be described with reference to FIG. 1 showing the electronical structure of the invention.

A pattern selection key 1 is selectively operated to select a desired pattern to be stitched.

A pattern number generating device 2 is responsive to the operation of the key 1 to generate a pattern number signal corresponding to the selected pattern.

A pattern number stack 3 temporarily stores the pattern number signal, with which to read out a pattern data from a pattern data storing memory 4.

A data calculation device 5 makes calculations with the pattern read out from the pattern data memory 4, a feed setting value taken out of a feed data stack 21, a pattern elongation setting value taken out from a pattern elongation data stack 26 or an amplitude setting value taken out from an amplitude data stack 33 to thereby produce the calculated pattern data when per rotation of the upper shaft of the sewing machine.

A detection device 6 continues to give the selected pattern data to a stitch forming device 7 and gives a high level signal when all data for the pattern have been transmitted to the stitch forming device 7.

An one-shot device 8 gives a high level signal when the pattern selection key 1 is operated while a discriminator 11 gives a low level signal with the discrimination that a controller 10 is not operated.

A memory key 9 is operated to give a high level signal to memorized a plurality of selected patterns. A controller 10 is operated to start the rotation of the upper shaft of the machine. The discriminator 11 gives a high level signal when the controller 10 is operated to start the machine.

A memory 12 is provided to temporarily store the number of pattern numbers to be stored in the pattern number stack 31. The memory 12 is set to zero (0) when a power source of the sewing machine is energized. A counted number is incrementally increased each time a high level signal is transmitted to the memory 12 from the memory key 9. The memory 12 is reset to zero (0) when a high level signal is transmitted thereto from the one-shot device 8.

A stack control counter 13 is operated to designate the data writing regions and data read-out regions of the pattern number stack 3, the feed data stack 21, the pattern elongation data stack 26, and of the amplitude data stack 33. The stack control counter 13 is set to 1(one) when the power source of the machine is energized, and ineremental counts up in response to a high level signal produced by operation of the memory key 9 or produced from the pattern data read-out detector 6 through OR-gate 37. The counter 13 is reset to 1(one) by a high level signal produced from a one-shot device 8 or from one-shot detector 15 and transmitted through OR-gate 38.

A comparator 14 is operated in response to a high level signal from the discriminator 11 to compare the counted value stored in the memory 12 and the value contented up by the stack control counter 13, and produce an accord signal when the counted-up value of the counter 13 comes to the value stored in the memory 12.

The one-shot detector 15 is responsive to the accord signal of the comparator 14 or a high level signal produced from the controller discriminator 11 when the controller 10 is operated, and gives a high level signal.

An elongated pattern discriminator 16 judges whether the pattern number taken out of the pattern number stack 3 is that of an elongatable pattern or not, and gives a high level signal when this is a pattern number of the elongatable pattern.

The flip-flop 17 determines whether a bus line control device 27 is made effective or not.

A feed pitch (or amount) UP key 18 is optionally operated to incrementally increase a counter value of a counter 20. A feed pitch DOWN key 19 is optionally operated to incrementally decrease a counter value of the counter 20. The counter 20 temporarily holds a feed pitch value selected by operation of the feed pitch UP key 18 and the feed manual DOWN key 19.

A feed pitch stack 21 stores a value of the counter 20 in the region designated by the stack control counter 13, and the value is taken out of the counter 20 when necessary.

A memory 22 has feed pitch display data stored therein and issues a display data corresponding to the feed pitch value taken out of the feed pitch stack 21. A feed pitch indication device 23 displays the display data issued from the memory 22.

A pattern elongation key 24 is operated to incrementally increase the counter value of a counter 25 by 1(one) each time the key is operated. The counter 25 temporarily preserves a pattern elongation value selected by an operation of key 24.

A pattern elongation stack 26 stores a value of pattern counter 25 in the region designated by the stack control counter 13 so that the value may be taken out when necessary.

The bus line control device 27 gives the pattern elongation value taken out of the pattern elongation stack 26, when the flip-flop 17 gives a high level signal.

A memory 28 stores pattern elongation display data and gives a display data in response to the pattern elongation value issued from the bus line control device 27.

An indication device 29 display the display data read out from the pattern elongation display data memory 28 or from an amplitude display data memory 35.

An amplitude UP key 30 is operated incrementally increase the counter value of the amplitude counter 32 by 1(one) each time the key operated.

The amplitude DOWN key 31 is operated to incrementally decrease the counter value of the amplitude counter 32 by 1(one) each time the key is operated. The amplitude counter 32 temporarily preserves the amplitude value selected by operation of the amplitude UP key 30 and the amplitude DOWN key 31.

An amplitude stack 33 stores a value of the amplitude counter 32 in the region designated by the stack control counter 13 so that the value may be taken out when necessary.

The bus line control device 34 gives the amplitude taken out of the amplitude stack 33 when a flip-flop 36 gives a high level signal.

A memory device 35 stores amplitude display data and gives a display data in response to the amplitude value issued from the bus line control device 34.

The flip-flop 36 determines whether the bus line control device 34 is made effective or not and gives a high level signal when the power source of the machine is energized, and when the amplitude UP key 30 or the amplitude DOWN key 31 is operated.

On the contrary, when the output of the flip-flop 17 changes from low level to high level, the output of the flip-flop 36 becomes a low level.

The flip-flop 17 is low level when the power source of the machine is energized and gives a high level signal when the elongated pattern discrimination device 16 gives a high level signal and additionally the pattern elongation key 24 is operated or when the controller ON/OFF descrimination device 11 gives a high level signal, and gives a low level signal when the output of the flip-flop 36 changes from a low level one to high level one.

The reference numberals 37, 38, 40, 41, 42 are OR-gates and 39 is an AND-gate.

R1, R2, R3, R4, R5, R6 are pull-down resistors, S1, S2, S3, S4, S5, S6 are pish switches and V1 is a variable resistor.

The operation of the embodiment of the present invention will be explained with reference to FIG. 1.

First, when the power source of the sewing machine is turned on, the counter value of the number storing memory 12 is reset to 0 (zero), the counter value of the stack control counter 13 is reset to 1 (one), the flip-flop 17 is set to low level, and the flip-flop 36 is set to high level.

Next, operating the pattern selection key 1 is operated, a pattern number signal is generated from the pattern number generating device 2 and this pattern number is stored in the region of the pattern number stack 3 designated by the value 1 (one) of the stack control counter 13.

When the feed pitch UP key 188 or the feed pitch DOWN key 19 is operated to set the feed pitch value of the counter 20, the feed pitch value is stored in the region of the stack 21 designated by the value 1 (one) of the stack control counter 13.

On the other hand, when the amplitude UP key 30 or the amplitude DOWN key 31 is operated to set the amplitude value of the counter 32, the amplitude value is stored in the region of the amplitude stack 33 designated by the value 1 (one) of the stack control counter 13.

If the selected pattern is elongatable by way of the data calculation device 5 increases the pattern stitches while maintaining the selected feed pitch, a pattern elongating magnification value is stored in the region of the stack 26 designated by the value 1 (one) of the stack control counter 13 when the pattern elongating magnification value is set in the counter 25 by operation of the pattern elongation key 24.

Then the pattern number stored in the pattern number stack 3 is taken out, and is transmitted to the pattern data memory 4. Then the pattern data memory 4 is operated to read out therefrom the pattern data which correspond to the pattern number and transmit the data to the data calculation device 5. The data calculation device 5 is kept standstill until the sewing machine is started.

Simultaneously, the feed pitch value stored in the stack 21 is taken out and is transmitted to the data calculation device 5 and to the feed display data memory 22. The feed display data memory 22 is operated to read out therefrom the display data corresponding to the feed pitch value to be displayed in the feed pitch indication device 23 in a two-figure digital value as shown in FIGS. 2 and 3.

In the same manner, the pattern elongating value stored in the stack 26 is taken out and is transmitted to the pattern elongation display data memory 28 when the bus line control device 27 is effective, that is, when the flip-flop 17 is high level.

The memory 28 is then operated to read out therefrom the pattern elongation display data corresponding to the pattern elongating value to be displayed in the amplitude indication device 29 in a two-figure character as shown in FIG. 3.

The amplitude value stored in the stack 33 is similarly taken out, and is transmitted to the amplitude display memory 35 when the bus line control device 34 is effective, that is, when the flip-flop 36 is high level.

The amplitude display data memory 35 is then operated to read out therefrom the amplitude display data corresponding to the amplitude value to be displayed in the amplitude indication device 29 in a two-figure digital value as shown in FIG. 2. In this case, there is no chance that both the bus line control devices 27 and 34 are simultaneously effective.

When the memory key 9 is operated after the pattern selection key 1 has been operated, the counter value of the pattern number memory 12 is incremented by 1 (one) and changed from 0 (zero) to 1 (one), and the value 1 (one) of the stack control counter 13 is incremented by 1 (one) and becomes 2 (two), to thereby memorized the selected pattern in the memories 3 and 12.

At this state, if the pattern selection key 1, the feed stich UP key 18, the feed pitch DOWN key 19, and the pattern elongation key 31 are operated again, each value is stored in each stack region of the feed manual stack 21, the pattern elongation stack 26, the amplitude stack 33, while the pattern number is stored in the pattern number stack 3 designated by the value 2 (two) of the stack control counter 13 and the set values are displayed in the feed pitch indication device 23 and the pattern amplitude indication device 29.

By repeated operation of the memory key 9 each time after a different pattern has been selected, a plurality of the patterns can be memorized in combination to be repeatedly sewn.

In order to sew the memorized pattern or patterns, the controller 10 is operated to start the sewing machine and to simultaneously set the one-shot device 15 to high level to reset the stack control counter 13 to 1 (one), to thereby take out the selected values from the regions of the respective stacks as designated by the value "1" of the counter 13. Thus each display data is transmitted to the indication device 23 and another indication device 29 while pattern data and set values are transmitted to the data calculation device 5 in the manner as mentioned above.

When the sewing machine is started, the upper shaft produces a timing signal per rotation thereof, and the data calculation device 5 is responsive to the timing signal to issue the calculated pattern data to the pattern forming device 7 through the pattern-finished detection device 6.

When the detection device 6 detects that the data calculation device 5 has issued all data for one pattern, the detection device 6 gives a high level signal to increase the value of the stack control counter 13 by 1 (one).

Then the next data for the next pattern are taken out from the regions of the respective stacks as designated the value of the stack control counter 13. The taken out data are displayed and used to form a pattern as described above.

Thus the memorized patterns are stitched one after another. When all the patterns memorized have been stitched, the counter value of the pattern number memory 12 and the value of the stack control counter 13 become equal, and the output signal of the comparator 14 changed from low level to high level to actuate the one-shot detection device 15, to thereby reset the stack control counter 13.

When an operation of sewing or the controller 10 is stopped, the output signal of the control discrimination device 11 is changed from high level to low level. At that time, if the pattern selection key 1 is operated, the one-shot device 8 is actuated to set the counter value of the pattern memory number storing memory 12 to 0 (zero) and the value of the stack control counter 13 at 1 (one), to thereby set the control system to the initial condition when the power source of the machine was turned on.

What is claimed is:

1. A sewing machine having pattern selecting means selectively operated to select a pattern to be stitched from a plurality of different patterns stored in a pattern memory, feed pitch setting means operated to set a desired feed pitch value of a selected pattern and simultaneously read out a data corresponding to the set feed pitch value of the selected pattern from a plurality of feed pitch display data stored in a feed pitch data memory which is to be digitally displayed in a first display, stitch amplitude setting means optionally operated to set a desired stitch amplitude value of the selected pattern and simultaneously to read out a data corresponding to the set stitch amplitude value of the selected pattern from a plurality of stitch amplitude display data which is to be digitally displayed in a second display, said sewing machine comprising means for setting an elongating magnification value of the selected pattern; memory means storing a plurality of pattern elongating magnification display data, said memory means being operated in response to operation of said pattern elongating magnification value setting means to produce a pattern elongating magnification display data corresponding to the set elongating magnification value of the selected pattern; means operated in response to operation of said pattern selecting means to discriminate if the selected pattern is elongatable, said discriminating means giving a signal upon confirmation that the selected pattern is elongatable; and switching means operated in response to the signal from said discriminating means and to operation of said pattern elongating magnification value setting means to electrically transmit the data of said pattern elongating magnification display data memory to said second display so as to make the latter digitally display said set elongating magnification value of the selected patterns while electrically disconnecting said stitch amplitude display data memory from said second display.

* * * * *